US005464988A

United States Patent [19]

Rossmassler et al.

[11] Patent Number: 5,464,988

[45] Date of Patent: Nov. 7, 1995

[54] TRITIUM WASTE PACKAGE

[75] Inventors: Rich Rossmassler, Cranbury; Lloyd Ciebiera, Titusville; Francis J. Tulipano, Teaneck; Sylvester Vinson, Ewing; R. Thomas Walters, Lawrenceville, all of N.J.

[73] Assignee: The United States of America as represented by the Department of Energy, Washington, D.C.

[21] Appl. No.: 347,134

[22] Filed: Nov. 23, 1994

[51] Int. Cl.[6] ..... G21F 9/30; G21F 5/00

[52] U.S. Cl. ..... 250/507.1; 250/506.1; 588/16

[58] Field of Search ..... 250/506.1, 507.1; 588/16

[56] References Cited

U.S. PATENT DOCUMENTS 4,950,426 8/1990 Markowitz et al. ..... 250/507.1

FOREIGN PATENT DOCUMENTS 1148671 6/1983 Canada ..... 588/16

61-18718 5/1986 Japan ..... 250/506.1

*Primary Examiner*—Jack I. Berman

*Attorney, Agent, or Firm*—Mark P. Dvorscak; Robert J. Fisher; William R. Moser

[57] ABSTRACT

A containment and waste package system for processing and shipping tritium oxide waste received from a process gas includes an outer drum and an inner drum containing a disposable molecular sieve bed (DMSB) seated within outer drum. The DMSB includes an inlet diffuser assembly, an outlet diffuser assembly, and a hydrogen catalytic recombiner. The DMSB absorbs tritium oxide from the process gas and converts it to a solid form so that the tritium is contained during shipment to a disposal site. The DMSB is filled with type 4A molecular sieve pellets capable of adsorbing up to 1000 curies of tritium. The recombiner contains a sufficient amount of catalyst to cause any hydrogen add oxygen present in the process gas to recombine to form water vapor, which is then adsorbed onto the DMSB.

7 Claims, 1 Drawing Sheet

TRITIUM WASTE PACKAGE

CONTRACTUAL ORIGIN OF THE INVENTION

The United States Government has rights in this invention pursuant to Contract No. DE-AC02-76CH03073 between the U.S. Department of Energy and Princeton University.

BACKGROUND OF THE INVENTION

This invention relates to a device for processing tritium oxide waste. The device receives waste tritium oxide from a gas stream, processes it, and serves as a container for shipment of the tritium waste.

Tritium oxide waste is generated from the tokamak fusion test reactor (TFTR) at Princeton University. To dispose of this waste, a container has been developed that processes the tritium oxide and also serves to transport the waste to a disposal site. The development of this container came from the need to process and ship tritium waste in a container that meets all federal and state transportation requirements for the shipment of such waste. Specifically, it was necessary to provide a container capable of shipping Type A quantities (less than 1000 curies) of tritium. The container also need to meet U.S. Departments of Energy and Transportation requirements.

It is therefore an object of the present invention to provide a container capable of processing less than 1000 curies of tritium from a gas stream, and then serve as a shipment device for the tritium to a disposal site.

SUMMARY OF THE INVENTION

A containment and waste package system for processing and shipping tritium oxide waste received from a process gas may include an outer drum and an inner drum containing a disposable molecular sieve bed (DMSB) seated within outer drum. The DMSB includes an inlet diffuser assembly, an outlet diffuser assembly, and a hydrogen catalytic recombiner. A cushioning and heat-absorbing material in all void spaces between the outer and inner drums is also provided. The DMSB adsorbs tritium oxide from the process gas and converts it to a solid form so that the tritium is contained during shipment to a disposal site. The DMSB is filled with type 4A molecular sieve pellets capable of adsorbing less than 1000 curies of tritium. An internal baffle for distributing the process gas within the inlet diffuser is included. The inlet and outlet diffuser assemblies are physically isolated to prevent the molecular sieve from entering the diffusers. The recombiner contains a sufficient amount of catalyst to cause any hydrogen and oxygen present in the process gas to recombine to form water vapor, which is then adsorbed onto the DMSB.

BRIEF DESCRIPTION OF THE DRAWING

The above-mentioned and other features of the invention will become more apparent and be best understood, together with the description, by reference to the accompanying drawing, in which.

DETAILED DESCRIPTION OF THE INVENTION

Figure 1:
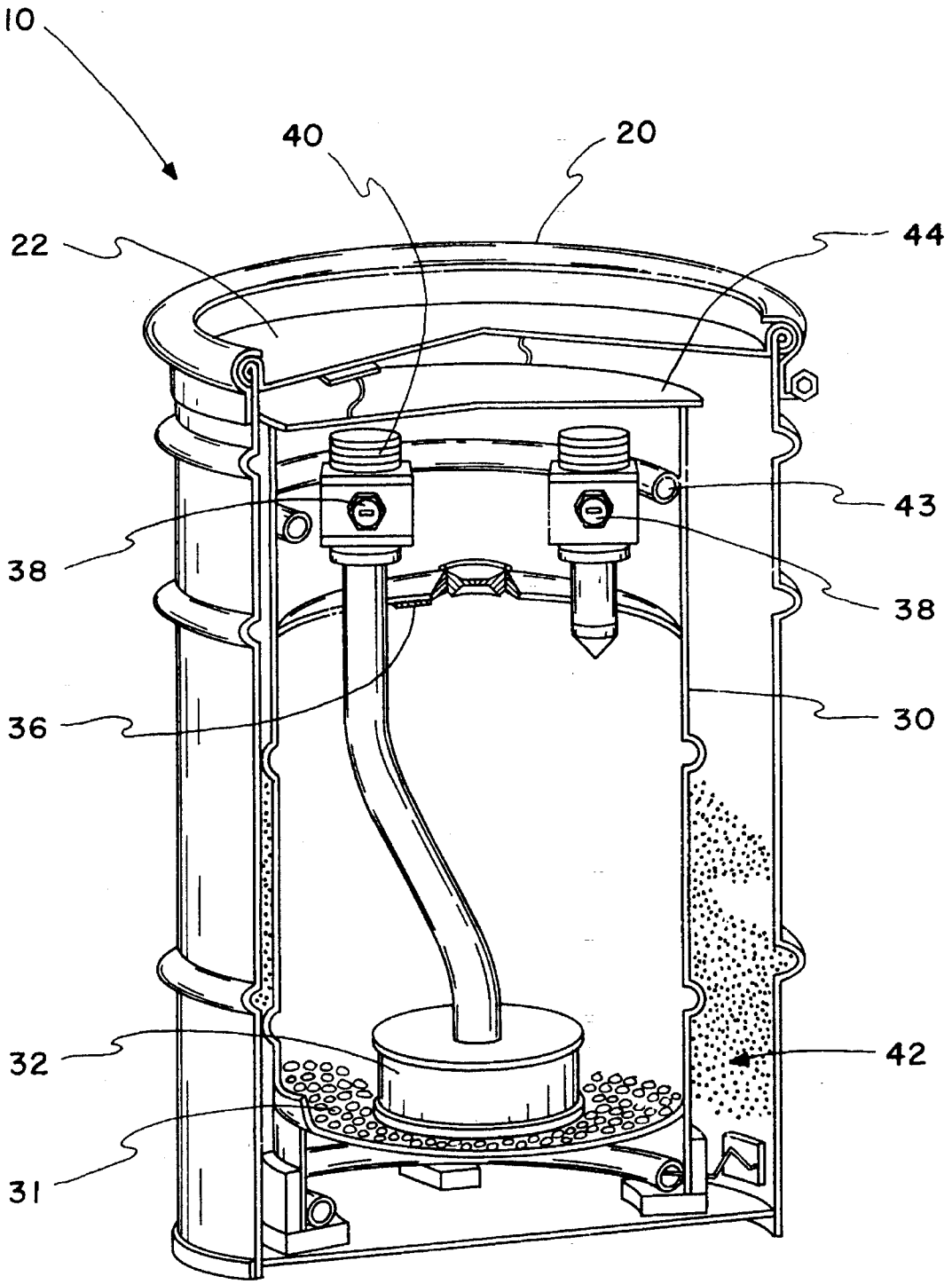
FIG. 1 shows a cut-away view of a tritium waste package in accordance with the present invention.

A containment system 10 for processing tritium oxide waste in accordance with the present invention is shown in cut-away view in FIG. 1. The system 10 includes an outer drum 20 and inner drum 30. Outer drum 20 is an unmodified U.S. Department of Transportation (DOT) 17C 55-gallon painted drum. It includes a removable top 22. Within the void of the outer drum 20 sits the inner drum 30. The drum 30 is the disposable molecular sieve bed (DMSB) that will ultimately contain the waste tritium. The DMSB 30 is a modified DOT 5C-304 15½ gallon corrosion-resistant drum, and includes an inlet diffuser assembly 32, and an outlet diffuser assembly 34. The inlet and outlet diffusers 32 and 34 are provided with ball valves 38. The valve outlets 38 are capped by means of flanges with copper gaskets 40. More specifically, the caps 40 include blind flanges with knife-edge sealing surfaces and copper gaskets. This configuration provides a metal-to-metal seal to ensure tight shut-off and to prevent leakage.

The DMSB 30 is provided with a cylindrical steel guard 43 and a steel cover plate 44 placed on the top of the guard. The guard 43 and cover plate 44 protects the structural integrity of the valves 38 and top of DMSB 30. The cover plate 44 also acts as a load spreader placed over the flanges 40 to ensure that the outer drum 20 will not be breached should the DMSB 30 move.

The DMSB 30 is filled with about 80 pounds of fresh Type 4A ⅛ inch cylindrical pellets molecular sieve bead 31. Preferably, the sieve pellets 31 are manufactured by UOP Inc, a wholly owned subsidiary of Allied Signal, or equivalent. This bead 31 sorbs the moisture from the gas stream thereby converting the tritium from a liquid form to a solid form, thus reducing the risk of leakage.

A hydrogen catalytic recombiner 36 is also provided within the DMSB 30. The hydrogen catalytic recombiner 36 has a wedge shape design and is attached to the top inside of the DMSB 30 as shown in FIG. 1. It is fabricated of 20-mesh stainless steel screen of welded construction. Preferably, the recombiner contains a mixture of at least 3 cc of Englehardt Deoxo type 18467 catalyst and Atomic Energy of Canada (AECL) No. 85-42 or 85-42-R catalyst in equal amounts. The Englehard Deoxo type 18467 catalyst is a palladium-on-alumina substrate, ⅛ inch cylindrical pellet (⅛ inch by ⅛ inch). The AECL No. 85-42-R catalyst is a ring catalyst, ( ¼ inch length by ¼ inch width with a ⅛ inch hole through the center). The AECL No. 85-42 is a ¼ inch spherical catalyst. Both AECL catalysts are hydrophobic, platinum-on silica substrates. The recombiner 36 functions to cause any $H_2$ and $O_2$ that may be present to recombine to form water vapor, which is then adsorbed onto the molecular sieve 31.

The DMSB 30 is placed within the outer drum 20, and all void spaces between the two containers are filled with a cushioning, heat-absorbing, and packing material 42, such as sand.

The inlet and outlet diffuser assemblies 32 and 34 are circular, and are both completely wrapped with 20 by 20 mesh screen (not shown) to prevent the molecular sieve material 31 from entering the diffuser assemblies. This screening must cover the complete 360 degree circumference of the diffusers. The inlet diffuser 32 is also has an internal baffle (not shown) to distribute the waste gas within the diffuser.

The waste package 10 as disclosed can hold up to 16 pounds of water and less than 1000 curies of tritium. It can process waste gas from a gas stream at a rate of about 50 standard cubic feet per minute and a pressure of about 15.2 pounds per square inch (absolute), with 10,000 parts per million of water. This waste container also has a maximum helium-leak rate of $10^{-6}$ standard atmospheric cubic centimeters of helium per second. Tritium diffusion through the stainless-steel vessel 20 of the DMSB 30 is negligible for normal variations in temperature during storage, transportation, or burial. The container is capable of withstanding the anticipated pressure buildup for 120 years, the time required for 99.9% of the tritium to decay.

This description of a preferred embodiment of a tritium waste package has been presented for purposes of illustration and description. It is not intended to be exhaustive or to limit the invention to the precise form disclosed, and obviously many modifications and variations are possible in light of the above teaching. The embodiment was chosen and described to best explain the principles of the invention and its practical application. This description will enable others skilled in the art to best utilize the invention in various embodiments and modifications as are suited to the particular use contemplated.

The embodiments of the invention in which an exclusive property is claimed are defined as follows:

1. A containment and waste package system for processing and shipping tritium oxide waste received from a process gas stream comprising:

a) an outer drum having a removable top and a void space;

b) an inner drum seated within a portion of the void space of the outer drum, and containing a disposable molecular sieve bed (DMSB), c) the DMSB having i) an inlet diffuser assembly, ii) an outlet diffuser assembly, and iii) a hydrogen catalytic recombiner;

iv) inlet and outlet valves;

d) a cushioning and heat-absorbing material in all void spaces between the outer and inner drums, whereby the DMSB absorbs tritium oxide from the process gas and converts it to a solid form so that the tritium is contained during shipment to a disposal site.

2. The containment system of claim 1 wherein the DMSB is filled with type 4A molecular sieve pellets in an amount capable of adsorbing less than 1000 curies of tritium.

3. The containment system of claim 2 wherein the inlet diffuser includes an internal baffle for distributing the process gas within the inlet diffuser.

4. The containment system of claim 3 wherein the inlet and outlet diffuser assemblies are physically isolated to prevent the molecular sieve from entering the diffusers.

5. The containment system of claim 4 wherein the recombiner contains a sufficient amount of catalyst to cause any hydrogen and oxygen present in the process gas to recombine to form water vapor, which is then adsorbed onto the DMSB.

6. The containment system of claim 5 wherein the outlet valves are capped by a shutoff means that prevents leakage.

7. The containment system of claim 6 wherein the DMSB is provided with a means for protecting the outlet valves and a means for providing that the outer drum will not be breached in the event of movement by the DMSB.

* * * * *